United States Patent [19]

Finney

[11] Patent Number: 4,999,000

[45] **Date of Patent: * Mar. 12, 1991**

[54] GOLF CLUBHEAD WITH A HIGH POLAR MOMENT OF INERTIA

[76] Inventor: Clifton D. Finney, 1057 Oak Hills Pkwy., Baton Rouge, La. 70810

[ * ] Notice: The portion of the term of this patent subsequent to Feb. 6, 2007 has been disclaimed.

[21] Appl. No.: 450,747

[22] Filed: Dec. 14, 1989

Related U.S. Application Data

[63] Continuation-in-part of Ser. No. 289,908, Dec. 27, 1988, Pat. No. 4,898,387.

[51] Int. Cl.[5] ..... A63B 53/04

[52] U.S. Cl. ..... 273/167 R; 273/169; 273/171; 273/173

[58] Field of Search ..... 273/167–175, 273/164, 77 R, 77 A; 221/217–220

[56] References Cited

U.S. PATENT DOCUMENTS

| | | | |
|---|---|---|---|
| D. 202,715 | 11/1965 | Solheim | 273/167 D X |
| D. 207,227 | 3/1967 | Solheim | 273/167 D X |
| D. 248,783 | 8/1978 | Long | 273/167 F X |
| 3,042,405 | 7/1962 | Solheim | 273/168 X |
| 3,305,235 | 2/1967 | Williams | 273/81.2 |
| 3,873,094 | 3/1975 | Sebo | 273/169 X |
| 4,650,191 | 5/1987 | Mills | 273/164 |
| 4,655,459 | 4/1987 | Antonious | 273/171 |
| 4,693,478 | 9/1987 | Long | 273/164 |
| 4,702,477 | 10/1987 | Solomon | 273/169 X |
| 4,714,252 | 12/1987 | Roraback | 273/171 |
| 4,754,976 | 7/1988 | Pelz | 273/169 |
| 4,828,265 | 5/1989 | Antonious | 273/167 |
| 4,852,879 | 8/1989 | Collins | 273/164 |
| 4,871,174 | 10/1989 | Kobayashi | 273/169 X |
| 4,898,387 | 2/1990 | Finney | 273/167 F |
| 4,915,385 | 4/1990 | Anderson | 273/171 X |

FOREIGN PATENT DOCUMENTS

| | | | |
|---|---|---|---|
| 1232651 | 5/1971 | United Kingdom | 273/169 |

OTHER PUBLICATIONS

"If Your Putts Aren't Dropping", by Jerry Tarde, Jan., 1982, p. 92–93.

"Golf World" Magazine, (may, 1976 issue), p. 19.

"Golf Digest" Magazine, Dec., 1976 issue, p. 12.

*Primary Examiner*—Edward M. Coven

*Assistant Examiner*—Sebastiano Passaniti

[57] ABSTRACT

A golf clubhead comprises a body having a predetermined lower density and a head weight means is of a predetermined higher density. There is also a toe weight means of the portion of the head weight means in the toe section. The clubhead may have a mass profile means to position: (i) a substantial portion of the mass of the toe weight means away from the center of mass of the clubhead toward the toe; and (ii) the center of mass of the toe weight means behind the extreme front of the ball striking surface no higher than the mid-height of the toe weight means. A characteristic feature of 'said substantial portion of the toe weight means adjacent the toe comprises an expanded surface whereby both the height and width of the substantial portion of the toe weight means are generally greater than the length of said substantial portion of the toe weight means. The invention may also include a mass distribution means to decrease the relative mass of the body and the toe weight means in the region of the toe section near the center of mass of the clubhead and to position a substantial portion of the mass of the toe weight means adjacent the toe with the center of mass of the toe weight means behind the extreme front of the ball striking surface.

20 Claims, 5 Drawing Sheets

GOLF CLUBHEAD WITH A HIGH POLAR MOMENT OF INERTIA

CROSS-REFERENCE TO RELATED APPLICATIONS

The present work is a continuation-in-part application of the parent entitled, "A Golf Clubhead with a High Polar Moment of Inertia," filed Dec. 27, 1988 under Ser. No. 07/289,908, and issued as U.S. Pat. No. 4,898,387 on Feb. 6, 1990.

BACKGROUND

1. Field of the Invention

This invention relates to a weighted golf clubhead which tends to reduce twisting when a golf ball is struck.

2. Description of Prior Art

Most prior golf clubheads may be classified as having either a low or moderate polar moment of inertia as determined along a vertical reference axis: for example, a vertical twist axis axis through the center of mass of a clubhead. For purposes of presentation, the present discussion is confined to putter heads. However, the principles and practices described may be applied to any type of head including woods, irons, and utility clubs.

Any list of classic examples in the low inertia category would include the Cash-In of Spalding and the Bull's Eye of Titleist. These heads may be described as essentially bar-shaped.

Any list of classic examples in the moderate inertia category would include the Pal by Ping and the Inertial by Slotline. These heads may be described as modified bar-shapes. For the case of the Pal, mass is removed from the central region and positioned toward the extremes of toe and heel. In the case of the Inertial, mass is removed from the central region and positioned as higher density material toward the extremes of the toe and heel.

Let us draw a quantitative distinction between the terms low and moderate inertia by considering five-inch, 300-gram systems. A simple bar of this dimension and mass has a moment of inertia of about 4000 g-cm$^2$. Since in fact both the Cash-In and Bull's Eye have lengths less than five-inches, their actual moments are something under 4000 g-cm$^2$. Accordingly, any putter head with an inertia up to about 4000 g-cm$^2$ can be classified in the low inertia category.

On the other hand, both the Pal and the Inertial are available in sizes approximating a five-inch, 300 gram system. Under these circumstances the Inertial has a reported moment of 5,000 g-cm$^2$. A visual inspection of the Pal compared to the Inertial suggests that the Pal has a moment somewhere in the range of 4000–5000 g-cm$^2$. Accordingly, any putter head with inertia from about 4,000–6,000 can be classified in the moderate inertia category.

In turn, heads in the range above 6,000 g-cm$^2$ may be classified as having high inertia. However, inertia is only one of the basic physical characteristics of concern in the design of clubheads. It is also desirable that the center of mass of a clubhead be positioned correctly. Consideration of stability and loft indicate that the center of mass for the clubhead should be placed about midway between the heel and toe, preferably closer to the sole than the top of the clubhead. For most irons and putters the center of mass will be toward the front near the striking face, while for most woods it will be somewhat more rearward toward the midpoint between front and back.

Some examples of at least a potential for difficulty in the simultaneous combination of inertia and center mass may be found in the recent literature. For example, Reiss in U.S. Pat. No. 4,444,395 dated Apr. 24, 1984 described a moderate-to-high inertia clubhead wherein the toe weight was shaped so that its center of mass was in its top portion. As another example, Peltz in U.S. Pat. No. 4,754,976 dated Jul. 5, 1988 described a very high inertia clubhead where the center of mass of the inertial weight was about four inches behind the striking face.

DIRECTION OF THE CURRENT INVENTION

In the parent, a high inertia putter head with an aluminum body and lead weights was disclosed. It had a mass of 302 grams and was 5.0"×2.0"×1.2" in length, width, and height, respectively. As determined by mass-bit computation, it had a polar moment of about 10,000 g-cm$^2$. The center of mass for the head was positioned approximately at the midpoint of each dimension, but it favored the heel over the toe, the front over the back, and the sole over the top, respectively.

A high inertia head compared to a moderate inertia head is in general more highly defined in terms of structure regarding its mass, length, and density separations.

From the perspective of a golfer, there are two major practical outcomes of higher inertia. Many golfers feel that heads with moderate inertia such as the Pal and Inertial compared to heads with low inertia such as the Cash-In and Bull's Eye tend to offer greater accuracy from within about four feet of the cup. This is thought to result from a reduction in the tendency of the wrists and clubhead to twist on impact.

Applicant has had a similar experience when comparing his high inertia clubhead with moderate inertia heads. Only the range of accuracy increased from about four to about eight feet. The phrase, range of accuracy, is strongly provisional upon the ability of a golfer to take the clubhead straight back from and straight through the ball. In other words, even with a high inertia clubhead, a putt can still be missed. Now, however, the likely source of the error arises from being either inside or outside the proper arc, and not from a strange twist of the wrists in a phenomenon often described as the yips.

The second practical outcome of higher inertia has to do with the shortened period of conditioning required to obtain reasonable results on a putting green after a layoff from golf. It used take applicant at least six weeks of daily practice before observing satisfactory performance with a low inertia head. This period was cut to something in the range of two to four weeks for a moderate inertia head. Now with a high inertia head the conditioning period was further reduced to less than about a week.

Within this positive framework of high inertia, a new clubhead that is shorter in height and narrower in width and thereby more compact is disclosed. Concomitantly, the center of mass is brought forward and down on the head.

The twin goals of high inertia and a well-positioned center of mass on a more compact clubhead tend to require higher density inertial materials. For example, in the parent it was suggested that if a tungsten-based material were substituted for lead, the toe weight means might be narrowed considerably:

Actually, tungsten is only one possibility among a group of higher density elemental materials. A more complete list of possible heavy elements and their densities in grams per cubic centimeter includes: irridium at 22.65, neptunium at 20.45, osmium at 22.61, platinum at 21.45, plutonium at 19.82, rhenium at 21.04, tantalum at 16.60, tungsten at 19.35, and uranium at 19.05. However, some of these are rare, some are poisonous, some are radioactive, some are highly reactive chemically, and most are very expensive.

Among these tungsten seems like a material of choice since it is commonly used in industry. Tungsten powder in assorted mesh sizes is readily available at about $10.00 per pound in today's marketplace. A. J. Williams, Jr. in U.S. Pat. No. 3,305,235 dated Feb. 21, 1967 described a sintered form of tungsten and copper powders at a density of 16 grams per cubic centimeter. Assuming today's copper price of $1.35 per pound, the cost of materials for this sintered form is approximately $7.50 per pound.

Too, tungsten powder alloys are commercially available in the 16.9–18.5 g/cc density range. Since these alloys are both dense and machinable, they are a preferred form of tungsten. However, they tend to command a premium price.

Tungsten rod and sheet are also possibilities. While, their cost is considerably greater than that for tungsten powder, it is perhaps not so high as that for the alloys. However, tungsten rod and sheet are more difficult to machine and to work with than the alloys.

The present emphasis upon tungsten is not intended to exclude the possible use of other high density materials in the practice of the invention. While at the outset pure gold, for example, is very expensive, it is clearly technically superior to many forms of tungsten for the present application. Too, cost is relative. It may take a few thousand dollars worth of gold to produce a high inertia clubhead of the type under consideration here, but a professional golfer may have a few hundred thousand dollars at stake on a single eight foot putt.

OBJECTS AND ADVANTAGES

Accordingly, the several objects and advantages of my invention begin with a golf clubhead comprising a body having a predetermined lower density and a head weight means comprising at least one head weight whereby each such head weight is of a predetermined higher density greater than said predetermined lower density of said body as inertial weight for the clubhead.

Another object is to have a clubhead with a toe and heel, a front and back, and a top and a sole with an elongated ball striking surface toward the front.

Too, an object is to have a binding means to attach the head weight means to the clubhead; and to have a fastening means to affix a shaft between the heel and toe of the clubhead.

Still another object is to have a clubhead with a toe section and a heel section whereby the toe section extends from a vertical plane positioned perpendicularly at the midpoint of the length line of the clubhead to the extreme of the toe, and the heel section extends from said plane in the opposite direction to the extreme of the heel.

Moreover, another object is to have a clubhead with a toe weight means comprising at least one toe weight of the portion of the head weight means in the toe section as inertial weight for the toe section.

Another object is to have a mass profile means to position: (i) a substantial portion of the mass of the toe weight means away from the center of mass of the clubhead toward the toe; and (ii) the center of mass of the toe weight means behind the extreme front of the ball striking surface no higher than the mid-height of the toe weight means.

Too, another object is to have a characteristic feature of the substantial portion of the toe weight means adjacent the toe comprising an expanded surface whereby both the height and of the substantial portion of the toe weight means are generally greater than the length of the substantial portion of the toe weight means comprising the expanded surface.

Yet another object is to have the mass profile means include a volume means to cause the volume of the bottom portion of the toe weight means from the mid-height of the toe weight means downward to be at least as great as the volume of the top portion of the toe weight means from the mid-height of the toe weight means upward.

Still another object is to have the mass profile means include a density means to cause the density of the bottom portion of the toe weight means from the mid-height of the toe weight means downward to be greater than the density of the top portion of the toe weight means from the mid-height of the toe weight means upward.

Moreover, another object is to have a mass distribution means to decrease the relative mass consisting of the body and the toe weight means in the region of the toe section near the center of mass of the clubhead and to position a substantial portion of the mass the toe weight means adjacent the toe with the center of mass of the toe weight means behind the extreme front of the ball striking surface.

Another object is to have a ratio of masses between the toe weight means and the complete mass of the toe section of at least 0.15.

An additional object is to have a ratio of densities between of the toe weight means and the body of the clubhead in the toe section of at least 1.20.

Too, an object is to have an inertial material of the toe weight means with a density of at least 13.0 grams per cubic centimeter.

Yet an additional object is to have an inertial material of the toe weight means with a content of tungsten of at least 10 percent by weight.

Yet another object is to the have a clubhead which is a body casting.

An additional object is to have at least one cavity in the body casting to bind at least one toe weight to the toe section.

Moreover, another object is to have a toe weight means which has both a width and a height greater than its length.

Another object is to have a golf clubhead which is inertially stabilized with respect to twisting.

Other objects and advantages of the current invention are to provide a gold clubhead that is not necessarily heavier, longer, broader, or higher than ordinary; yields a good solid feel when a ball is struck; is aesthetically appealing to golfers; is and is economically attractive to both manufacturer and golfer.

Still more objects and advantages of my invention will become apparent from the drawings and ensuing description of it.

NUMERIC CODE

Figure 1:
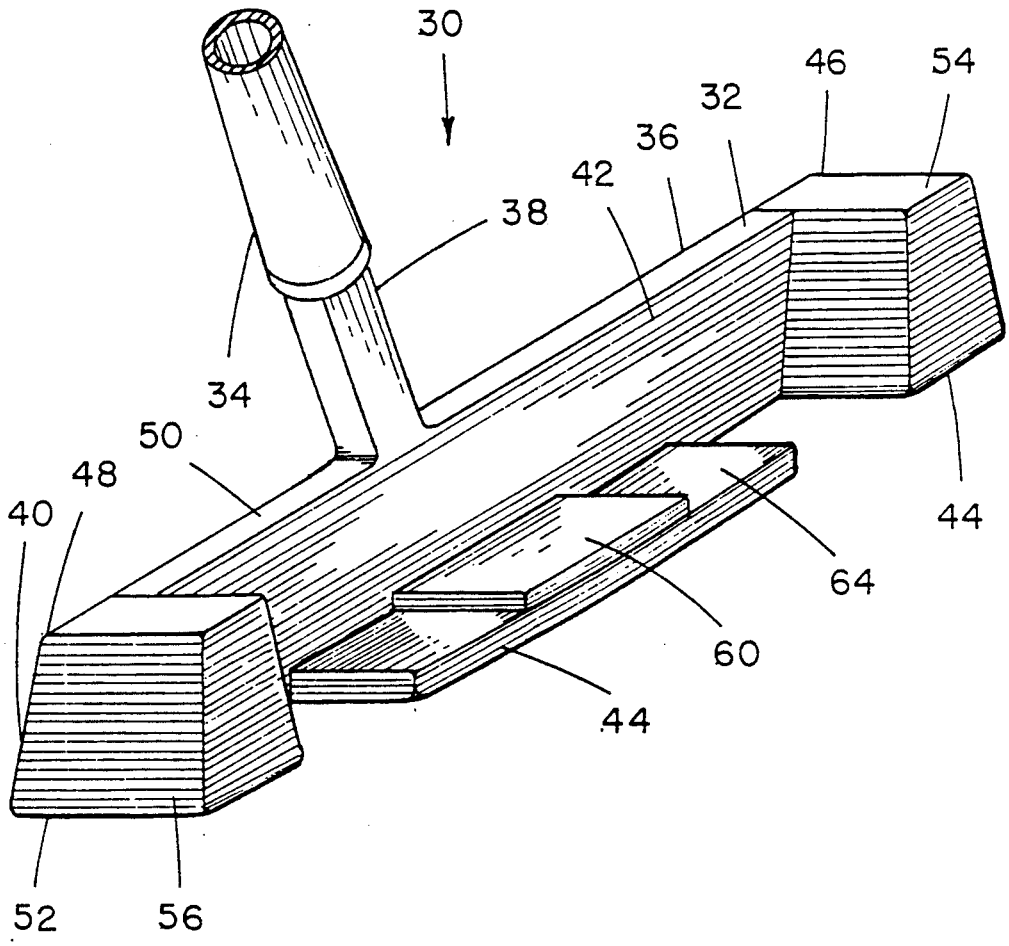
FIG. 1 is a perspective view of the clubhead of the present invention.

1–29: FIGURES
30–99: PARTS OF A PREFERRED EMBODIMENT
100–199: POINTS
200–299: AXES, LINES, SURFACES, AND ANGLES
300–399: DIMENSIONS

PARTS OF A PREFERRED EMBODIMENT

30: golf club putter
32: head
34: shaft
36: body
38: hosel
**38*a***: arm
**38*b***: collar
**38*c***: neck
40: ball striking surface toward the front of head 32
42: rear surface
44: back
46: toe
48: heel
50: top
52: sole or bottom
54: head weight or far toe weight or toe weight
56: head weight or far heel weight or heel weight
58: cylindrical pin for weight
60: head weight or central weight
**60*a***: head weight or toe portion of central weight or central toe weight
**60*b***: head weight or heel portion of central weight or central heel weight
62: cavity for central weight
64: extended sole
66: toe section
68: heel section

POINTS

100: center of mass of head 32
102: center of mass of toe weights 54 and **60*a***
106: geometric center of ball striking surface 40
108: center of golf ball circumference 202

AXES, LINES, SURFACES, AND ANGLES

200: horizontal ground surface
202: circumference of a golf ball
206: vertical twist or y-axis through geometric center 106
207: partial circumference of a circle in a horizontal plane with vertical twist axis 206 as center and length 307 as radius to reference center of mass 102 of toe weights 54 and **60*a***
208: angle of twist of head 32 when a ball as designated by circumference 202 is miss-struck a horizontal length 314 off the preferred spot here represented as geometric center 106.

DIMENSIONS, FIGS. 1–12

As a reminder, each of the following definitions assume that head 32 is soled on ground surface 200 in its normal position for addressing the ball.

300: horizontal length of head 32 between vertical projections of imaginary parallel planes that are perpendicular to the length line and placed at extremes of toe 46 and heel 48, respectively
302: half the length 300 of head 32
304: vertical height of head 32 between horizontal projections of imaginary parallel planes placed at extremes of top 50, excluding hosel 38, and sole 52 on ground surface 200, respectively
306: half the height 304
307: direct length from vertical twist or y-axis 206 to a vertical projection of center of mass 102 of toe weights 54 and **60*a***.
308: horizontal width of head 32 between vertical projections of imaginary parallel planes from extreme front toward ball striking surface 40 and extreme toward back 44 on a line perpendicular to 300
**310*a*: length of far toe weight 54**
**310*b*: width of far toe weight 54**
**310*c*: height of far toe weight 54**
**310*d*: half-height of far toe weight 54**
**312*a*: length of central toe weight 60*a***
**312*b*: width of central toe weight 60*a***
**312*c*: height of central toe weight 60*a***
314: horizontal length the center 102 of a golf ball as designated by circumference 202 is miss-struck off the preferred ball striking spot here represented as the geometric center 106.

DETAILED DESCRIPTION OF A PREFERRED EMBODIMENT

In FIG. 1 number 30 refers to a golf club putter of the current invention. It has a head 32 to which a separate shaft 34 is fastened to body 36 via hosel 38 with adhesive. On head 32 there is also a ball striking surface 40 toward the front which may be seen more directly in FIG. 2. Behind ball striking surface 40 are rear surface 42 and back 44. Head 32 also has a toe 46, a heel 48, a top 50, and a bottom or sole 52. In this embodiment ball striking surface 40 is positioned at the extreme front of head 32. In equally acceptable embodiments, other components, hosel 38 for example, may be positioned at the extreme front of head 32.

Figure 2:
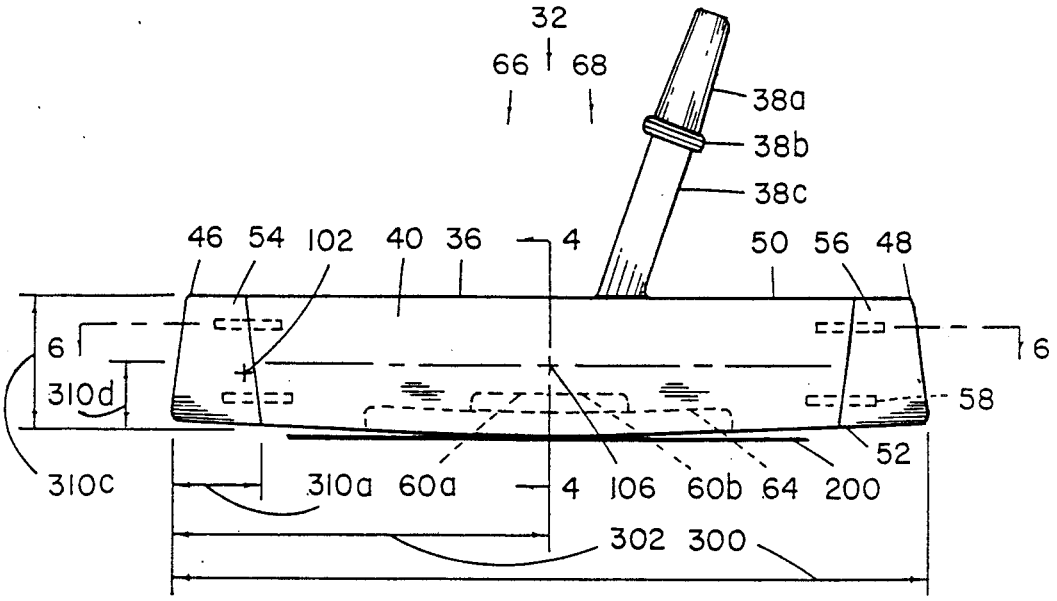
FIG. 2 is a front elevation view of the clubhead of FIG. 1.

The objects of the current invention center around the mass distribution on head 32. In this regard there are far toe weight 54, far heel weight 56, and central weight 60. As seen in FIGS. 2 and 6, far toe weight 54 and far heel weight 56 are each bound to body 36 over a single surface with two cylindrical steel pins 58. As seen in FIGS. 1 and 2 and 4–6, central weight 60 is bound to body 36 over multiple surfaces since a part rests on extended sole 64 and a part fits into a cavity 62 through the rear surface 42 of body 36. Each of the weights 54, 56, and 60 are also adhesively bonded to body 36.

In addition to or as an alternative for the pins 58, far toe weight 54 and far heel weight 56 could, for example, each be bound to body 36 by other means such as soldering, welding, or cavities. Conversely, as a substitute for cavity 62, central weight 60 might as well be bound to body 36 over a single surface with pins similar to cylindrical pins 58. Thus the exact means by which any head weight is tightly bound to head 32 may be an open aspect of the current invention.

Far toe weight 54, far heel weight 56, and central weight 60 are head weights since they are positioned on head 32. In this case they constitute the head weight means for head 32, and they may be separated from each other as shown, or they may be interconnected in any combination to give fewer than three head weights. Conversely, there may be more than three head weights.

As depicted body 36 is a casting and includes all material from ball striking surface 40 at the front to back 44 except for the material in shaft 34; weights 54, 56, and 60; pins 58; and the adhesive. Body 36 is a lower density material such as an aluminum alloy and head weights 54, 56, and 60 are each of a higher density material such as a tungsten alloy.

However, a variety of other lower density materials including graphite and a variety of other higher density materials including would also be suitable. As indicated earlier, it is not entirely unthinkable to include materials such as rhenium, gold, and platinum as possibilities in the high density category. Body 36 might also be constructed of a moderate density material such as steel.

The guiding principle is one of a lower density body 36 with a higher density head weight means. The former should have a density as low as possible and the latter should have a density as high as possible in any given set of circumstances. It is also true that any head weights such as 54, 56, and 60 need not all be of the same material. For a head weight to be a head weight, the density of its inertial material need only be higher than the density of the bodily material.

Too, any given head weight such as 54, 56, or 60 may be composed of more than one distinct material; and similarly any body such as 36 may be made up of more than one material. In these circumstance actual densities may be determined for the individual head weights 54, 56, and 60 and the body 36.

As shown body 36 is basically a blade with its width defined by the extreme of ball striking surface 40 toward the front and rear surface 42 toward the back 44. As previously indicated this blade-type body 36 also includes hosel 38 to fasten a shaft 34 and an extended sole 64 to rest head 32 on a ground surface. However, the particular configuration of body 36 is not necessarily critical to this invention. Instead for example, body 36 might be shaped in the form of a traditional wood or an iron.

With reference to the front elevation view of FIG. 2, clubhead 32 is resting in its normal address position on ground surface 200. The drawing displays all hidden lines of the components of head 32 behind ball striking surface 40. Shaft 34 is deleted in this and the following figures to illustrate more fully the details of hosel 38. It has an arm 38*a* onto which shaft 34 may slide, a retaining collar 38*b*, and a neck 38*c* which joins body 36 at top 50.

Horizontal length 300 is the heel-to-toe length for head 32. Half-length 302 from the extreme of toe 46 is is half the length 300. Half-length 302 defines the position of vertical cut-plane 4—4 which is perpendicular to both ground surface 200 and length line 300. Cut-plane 4—4 divides head 32 into a toe section 66 and a heel section 68. As seen in FIG. 2, hosel 38 accompanies the heel section 68. This will be the case for many clubheads including particularly heel-shafted putters, irons, woods, and utility clubs.

It will also be seen in FIG. 2 that head weight 54 is positioned completely within the toe section 66. However, head weight 60 is positioned only partially within the toe section 66. The part of central weight 60 within the toe section 66 is numbered 60*a* and may be referred to as central toe weight 60*a*, and the part of central weight 60 within the heel section 68 is numbered 60*b* and may be referred to as central heel weight 60*b*.

Since head weights 54 and 60*a* are positioned completely within the toe section 66, they may both be viewed as being toe weights. Thus, any head weight material positioned on the toe side of cut-plane 4—4 is a toe weight whether or not it is physically joined to head weight material in the heel section 68. It follows from the discussion on head weights given above that toe weights 54 and 60*a* may be separated from each other as shown, or they may be interconnected to form one toe weight. Also, there may be more than two such toe weights.

Figure 3:
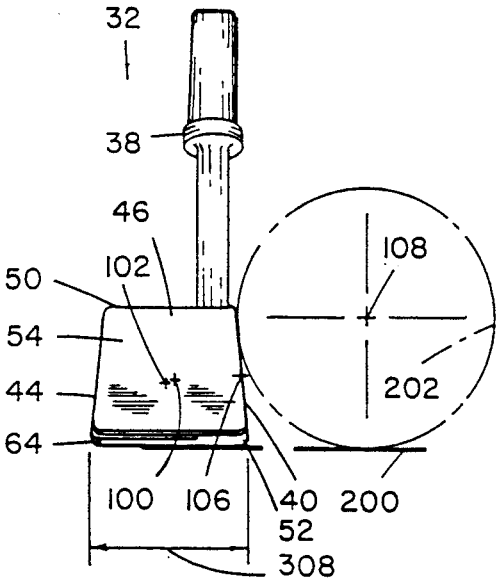
FIG. 3 is a side elevation view of the toe end of the clubhead of FIGS. 1 and 2.

Also in FIG. 2, half length 302 sets one of the coordinates for geometric center 106 on ball striking surface 40. The other coordinate for geometric center 106 is half-height 306 as referenced from ground surface 200 in FIG. 4. It is half the vertical height 304 of head 32 which is measured from the extreme of top 50 excluding hosel 38 to the extreme of sole 52 on ground surface 200. The horizontal width 308 of head 32 is shown in FIG. 3.

In this embodiment the highest point of head 32 is seen to be anywhere on top 50 excluding the region where top 50 and neck 38*c* intersect. This will not be true generally. On many iron-type clubheads the highest point on head 32 excluding hosel 38 will be near the toe end 46 of toe section 66. On many wood-type clubheads the highest point on head 32 excluding hosel 38 will be in the central region above and behind geometric center 106. However, Antonious in U.S. Pat. No. 4,828,265 dated May 9, 1989 disclosed a new wood-type clubhead having a deep, channel-shaped cavity formed in the central region of the top surface and extending rearward so that the highest point on the head 32 excluding hosel 38 may be toward the toe 46. Conversely, Long in U.S. Des. Pat. No. 248,783 dated Aug. 1, 1978 illustrated a putter head 32 which also has its highest point excluding hosel 38 in the central region behind geometric center 106.

Consideration of clubheads such as that disclosed by Antonious indicate that the portion of ball striking surface 40 which in most cases would contain geometric center 106 might be missing in some cases if such a channel were cut deep enough. In the event that this portion of the ball striking surface were missing, a fair projection of the surrounding ball striking surface 40 may be performed, and the geometric center 106 may be placed appropriately on the projected surface.

FIG. 2 also illustrates the horizontal length 310*a* and the vertical height 310*c* of far toe weight 54. The horizontal width 310*b* of far toe weight 54 may be seen in FIG. 5. From FIGS. 1–2 and 5, it is seen that both width 310*b* and height 310*c* are greater than length 310*a* of far toe weight 54. This helps to promote a large moment of inertia about a vertical reference axis such as twist axis 206 through geometric center 106.

Half-height 310*d* of toe weight 54 in FIG. 2 is referenced from its extreme lower point on sole 52 which is slightly above ground surface 200 when head 32 is fairly grounded. The upper extent of half-height 310*d* marks the mid-height of toe weight 54. Since the height 312*c* of central toe weight 60*a* is entirely within the range of height 310*c* of far toe weight 54, the mid-height of far toe weight 54 is also the mid-height of the entire toe weight means for this case. In FIG. 2 it is seen that the center of mass 102 for the toe means is below its mid-height. Center 102 is also below geometric center 106. The facts that far toe weight 54 is almost a regular prismatoid and that central toe weight 60*a* is positioned entirely below geometric center 106 both help in promoting a lower center of mass 102 which is a key aspect of the invention.

Lastly in FIG. 2, horizontal cut-plane 6—6 is positioned so that it intersects the receivers for cylindrical pins 58 in far toe weight 54, far heel weight 56, and body 36, respectively.

FIG. 3 emphasizes the expanded surface of far toe weight 54 adjacent toe 46 from ball striking surface 40 at the front to back 44 and from top 50 to sole 52. This expanded area may be viewed as a compression of toe weight 54 onto toe 46 by making its length 310*a* less than its width 310*b* and its length 310*a* also less than its height 310*c* as previously indicated. Too, the expanded surface may be viewed in the context of the width 308 and height 304 of head 32 whereupon the expanded surface covers a substantial portion of the total area defined by width 308 and height 304.

Figure 5:
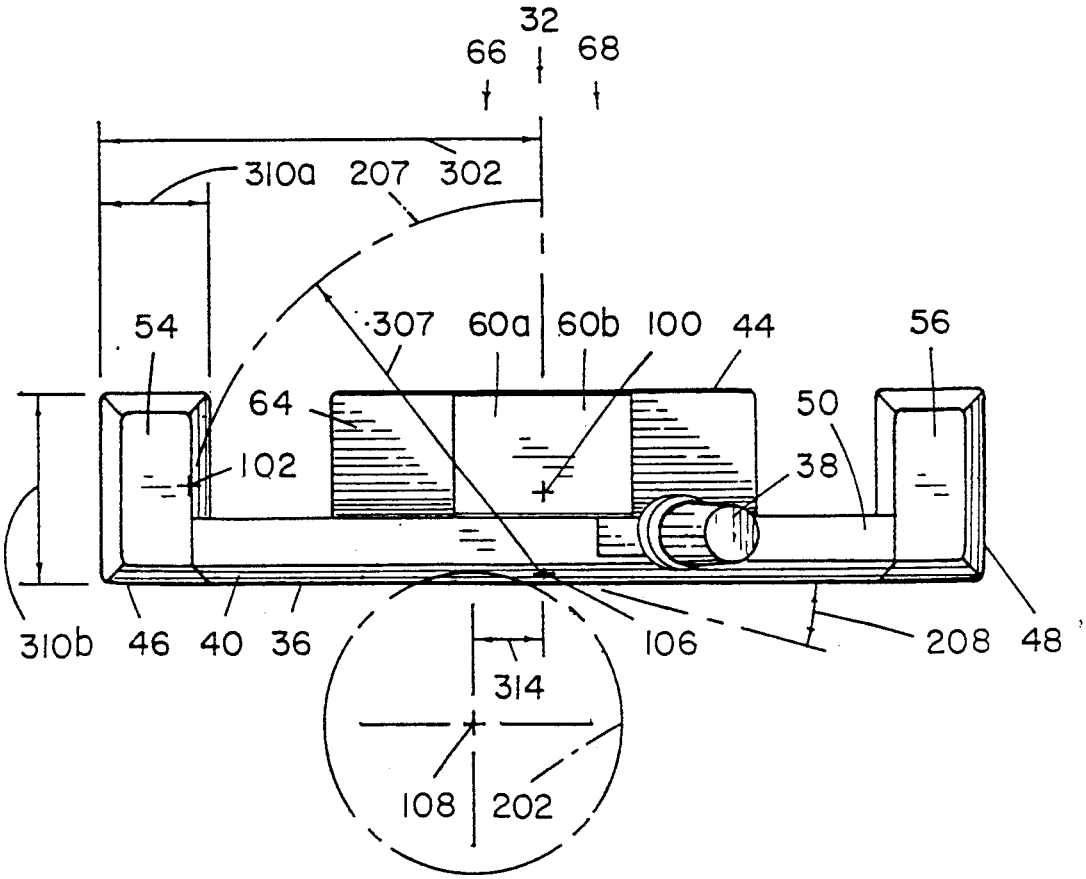
FIG. 5 is a top plan view of the clubhead of FIGS. 1–3.
Figure 6:
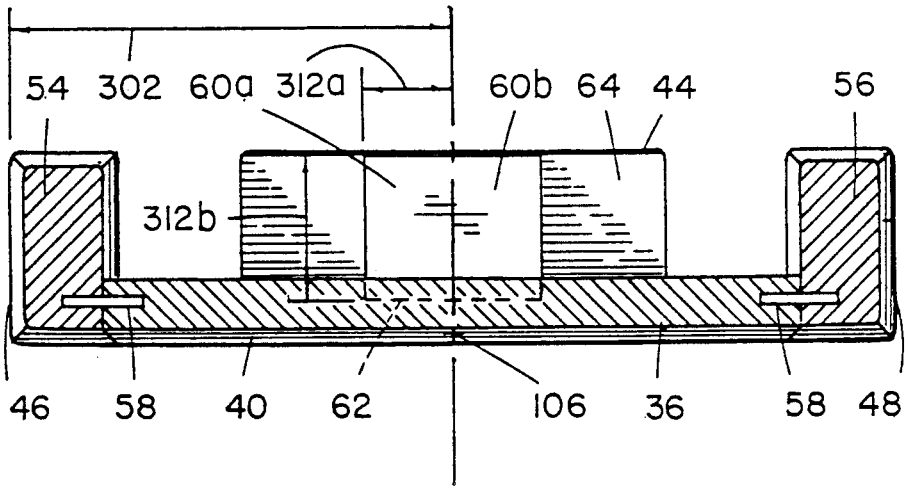
FIG. 6 is a top cross-sectional view of the clubhead of FIG. 2 as shown along line 6—6.
Figure 7:
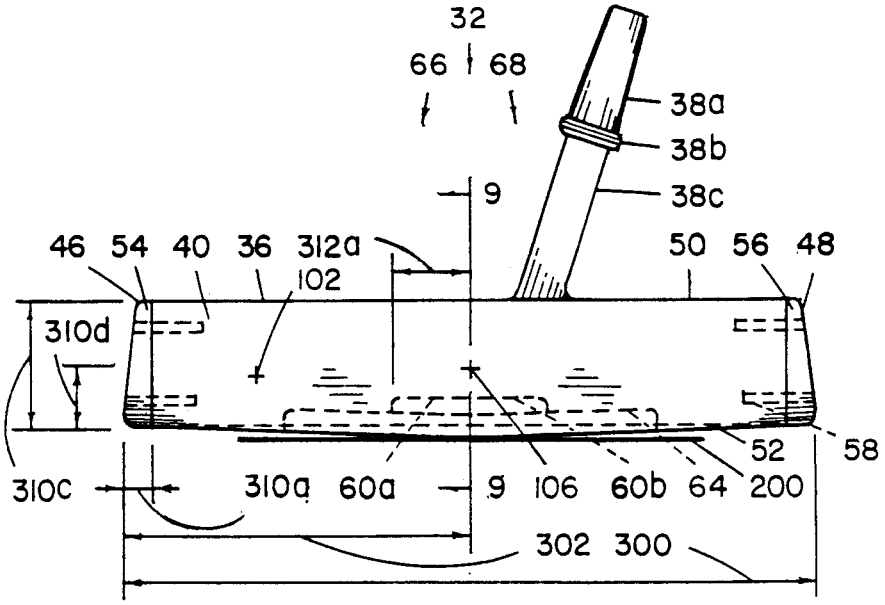
FIG. 7 is a front elevation view of a clubhead similar to that in FIGS. 1–6 with the toe weight now extended toward the heel.
Figure 8:
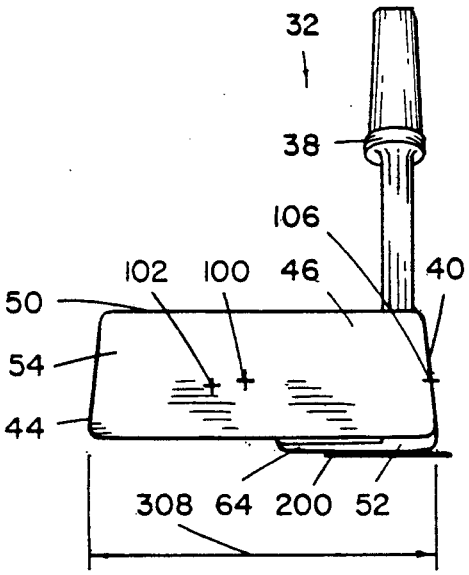
FIG. 8 is a side elevation view of the toe end of the clubhead of FIG. 7.
Figure 9:
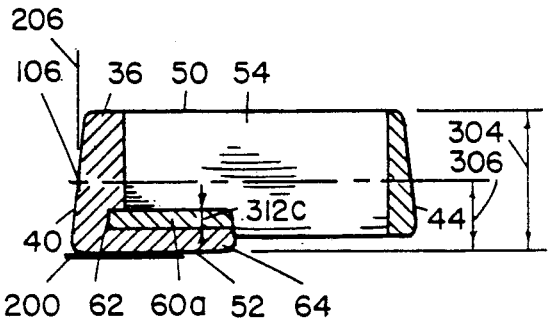
FIG. 9 is a cross-sectional side elevation toward the toe end of the toe section of the clubhead of FIG. 7 as shown along the line 9—9.

It is necessary to remember that dimension set 300, 304, and 308; dimension set 310*a*–310*c*; and dimension set 312*a*–312*c* are part of a single mutually perpendicular measurement system based upon projections so as to distinguish them from dimension 307 in FIG. 5 which is a direct length.

Other relationships and points of interest in FIG. 3 include how ball striking surface 40 relates to the circumference of a golf ball 202 on ground surface 200 with center 108. Too, the center of mass 100 of head 32 is seen to be slightly forward and up from the center of mass 102 of toe weights 54 and 60*a* due to the generally forward and relatively up distribution of mass in body 36. However, center of mass 100 of head 32 is still below geometric center 106 and the center 108 of golf ball circumference 202. Finally, center of mass 102 of toe weights 54 and 60*a* is seen positioned behind the extreme front of ball striking surface 40.

Figure 4:
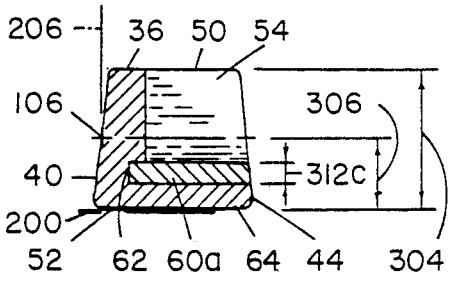
FIG. 4 is a cross-sectional side elevation view toward the toe end of the toe section of the clubhead of FIG. 2 as shown along the line 4—4.

With reference to the right-hand-side of FIG. 4 vertical height 304 and half-height 306 referenced from the central part of sole 52 on ground surface 200 are very much in evidence. This part of the diagram also shows the maximum height 312*c* of central toe weight 60*a* as it rests in cavity 62 and on extended sole 64 of body 36. The length 312*a* and the width 312*b* of central toe weight 60*a* may be found in FIG. 6.

To the left in FIG. 4 there is vertical twist axis 206 through geometric center 106 of ball striking surface 40. At the top 50, far toe weight 54 is manifest.

The concept of a toe section 66 and a heel section 68 for head 32 may be reviewed from a top perspective in FIG. 5. Here half-length 302 is referenced from the extreme of toe 46. An imaginary vertical plane perpendicular to line 302 at its most central point and intersecting geometric center 106 divides head 32 into the toe section 66 extending on through the extreme of toe 46 and into the heel section 68 extending on through the extreme of heel 48.

In FIG. 5 direct horizontal length 307 is also illustrated. It runs from vertical axis 206 through the geometric center 106 of ball striking surface 40 to the partial horizontal circumference 207 which passes through a vertical projection of the center of mass 102 of toe weights 54 and 60*a*. It was indicated in the parent that it is desirable to have the ratio of length 307 to half-length 302 be as great as possible. This is another way of expressing the idea of compressing toe weights 54 and 60*a* toward toe 46 to promote a enhanced moment of inertia about vertical twist axis 206.

Finally in FIG. 5 the angle of twist 208 of head 32 is shown. It may apply when a ball as represented by circumference 202 is miss-struck a length 314 from the preferred spot. More specifically, length 314 is represented as the distance from geometric center 106 to the center 108 of golf ball circumference 202. The argument can be made that a slightly better representation of length 314 would involve the distance from center of mass 100 of head 32 to the center 108 of golf ball circumference 202. However, as seen in FIG. 5, such a distinction is virtually inconsequential since center of mass 100 is only marginally to the right of geometric center 106 due to the small assymetric contribution of hosel 38 to center of mass 100 in an otherwise symmetric head 32 along the toe 46 to heel 48 axis. Accordingly, it may be seen in FIG. 5, that the relatively large mass combined with the position of toe weight 54 adjacent toe 46 will enhance the moment of inertia of head 32 and thereby tend to reduce the angle of twist 208 when a ball is miss-struck any length 314.

The cross-sectional drawing of FIG. 6 illustrates the placement of top cylindrical pins 58 between toe weight 54 at the toe 46 and heel weight 56 at the heel 48 and body 36, respectively. While body 36 and weights 54 and 56 are shown in cross-section, cylindrical pins 58 are shown in full section placed on the bottom half of their cylindrical receivers in weights 54 and 56 and body 36, respectively.

As indicated previously length 312*a* and width 312*b* are dimensions for central toe weight 60*a*. For purposes of a detailed understanding of the values for such dimensions in TABLE I, it is worth noting that the placement of central weight 60 is very slightly forward of the extreme point of back 44. This may seen more clearly along the right-hand side of the cross-sectional view of FIG. 4.

TABLE I

Density, masses, dimensions, and critical ratios for a preferred embodiment similar to that in FIGS. 1–6.

| | |
|---|---|
| Density of aluminum in body 36 | 2.70 g/cm$^3$ |
| Density of tungsten alloy in weights 54, 56 and 60 | 17.0 g/cm$^3$ |
| Mass of head 32 with hosel 38 | 305 g |
| Mass of body 36 with hosel 38 | 61.7 g |
| Mass of hosel 38 | 6.07 g |
| Mass of body 36 in toe section 66 | 27.8 g |

TABLE I-continued

| Density, masses, dimensions, and critical ratios for a preferred embodiment similar to that in FIGS. 1-6. | |
|---|---|
| Mass of toe weight 54 | 110 g |
| Mass of central weight 60 | 23.7 g |
| Mass of central weight 60a in toe section | 11.8 g |
| Complete mass of toe section 66 | 150 g |
| Horizontal length 300 of head 32 | 5.00 in. |
| Half-length 302 of head 32 | 2.50 in. |
| Horizontal width 308 of head 32 | 1.07 in. |
| Vertical height 304 of head 32 | 0.900 in. |
| Half-height 306 of head 32 | 0.450 in. |
| Length 310a of toe weight 54 | 0.603 in. |
| Width 310b of toe weight 54 | 1.05 in. |
| Height 310c of toe weight 54 | 0.824 in. |
| Half-height 310d of toe weight 54 | 0.412 in. |
| Length 312a of toe weight 60a | 0.500 in. |
| Width 312b of toe weight 60a | 0.800 in. |
| Height 312c of toe weight 60b | 0.116 in. |

Similarly, the width **310*b* of far toe weight 54 shown in FIG. 5 is very slightly less than the width 308 of head 32 shown in FIG. 3. As seen in FIGS. 2 and 3 far toe weight 54 is slightly elevated off ground surface 200. That fact combined with the generally prismoidal shape of toe weight 54 results in the very slight decrease of width 310*b* relative to the width 308 of head 32. Width 308 is maximal in the central region directly below geometric center 106 on ground surface 200 from the extreme at the front of ball striking surface 40 to the extreme at the back 44**.

The data in TABLE I represent a head 32 similar to that in FIGS. 1-6. From the preceeding description of FIGS. 1-6 and the data in TABLE I, many of the objects of the invention have already been illustrated.

More specifically, an object was to have a mass profile means to position: (i) a substantial portion of the mass of the toe weight means away from the center of mass 100 of the clubhead 32 toward the toe 46; and (ii) the center of mass 102 of the toe weight means behind the extreme front of the ball striking surface 40 no higher than the mid-height of the toe weight means. Once again, in this case the mid-height of the toe weight means is the central extent of the half-height **310*d* of toe weight 54** as referenced from its top or bottom.

From TABLE I the mass of toe weights 54 and **60*a* as the toe weight means is about 122 grams with some 90% of the total deposited as a substantial portion in toe weight 54 away from center of mass 100 of head 32 adjacent toe 46. Too, the half-height 310*d* of 0.412 inches for toe weight 54 is also the half-height for the toe weight means including toe weights 54 and 60*a*. This is derived from fact that the maximum extended height of this toe weight means is just height 310*c* of toe weight 54. With the top 50 as reference this places the mid-height of the toe weight means at 0.488 inches above ground surface 200 in FIG. 2. Separate calculation places the position of center of mass 102 of toe weights 54 and 60*a* at only 0.412 inches above ground surface 200. As seen in FIG. 3 center of mass 102 of toe weights 54 and 60*a* is behind the extreme front of ball striking surface 40**. Accordingly, this object is fullfilled.

Another object was to have a characteristic feature of the substantial portion 54 of the mass of the toe weight means adjacent the toe comprising an expanded surface whereby both the height **310*c* and width 310*b* of the toe weight means are generally greater than the length 310*a* of the substantial portion of the toe weight means comprising the expanded surface. As discussed, inspection of the drawings and the data in TABLE I reveals that the height 310*c* is greater than the length 310*a* and that the width 310*b* is also greater than the length 310*a***. However, there are some aspects of these dimensions which require additional commentary.

If the maximum extended height of the toe weight means was not exemplified by one member as it is in this case with height **310*c*, then the maximum height of the entire toe weight means from top to bottom should be used. For example, suppose the top of toe weight 54 was closer to the top 50 than the top of toe weight 60*a* was, while the bottom of toe weight 60*a* was closer to the extreme of sole 52 on ground surface 200 than toe weight 54 was. In this case the vertical height of the toe weight means would run from the bottom of toe weight 60*a* to the top of toe weight 54**, and the half-height of the toe weight means as referenced from its top or bottom would then be derived from this value. In turn, the central extent of this half-height would then yield the mid-height of the toe weight means.

In a similar manner, the maximum extended width of the toe weight means is, in the present case, given by the width **310*b* of the toe weight 54. However, if toe weight 54 was positioned more toward the front than toe weight 60*a* was, and if toe weight 60*a* was positioned more rearward toward back 44 than toe weight 54 was, then the horizontal width of the toe weight means would run from the front extreme of toe weight 54 to the rear extreme of toe weight 60*a***. Additional commentary on the extended width of the toe weight means may be found in the next section.

In FIGS. 1-2 and 5, it is apparent that toe weight **60*a* could be reduced even more in height and extended toward toe 46 to join toe weight 54 yielding a toe weight means comprising a single toe weight. In this event toe weight 54 would no longer have a discrete length 310*a*. Since toe weight 54 is the substantial portion of the toe weight means adjacent the toe 46, and since the objectives and appended claims require a fair value for its length, reasonable procedures may be used to ascertain a fair value. For this postulated case, a planar extrapolation could be performed on the large and dominating interior wall of toe weight 54 that faces center of mass 100 of head 32. This planar extrapolation would divide toe weight 54 and 60*a* near the bottom of toe weight 54. Of course, the new length 310*a* of the new toe weight 54 would then be same as the old length 310*a*** given in TABLE I.

Another object of the invention was to have the mass profile means include a volume means to cause the volume of the bottom portion of the toe weight means from the mid-height of the toe weight means downward to be at least as great as the volume of the top portion of the toe weight means from the mid-height upward. Separate calculations show that 57% of the volume of toe weight 54 is below the central extent of its half-height **310*d* when referenced as shown in FIG. 2 due to its generally prismoidal shape. By inspection of FIG. 2, all of toe weight 60*a*** is below this central extent so that the even larger value of 61% of the total volume of the toe weight means is in its bottom portion. Accordingly, this object is also fulfilled.

A further object of the invention was to have the mass profile means include a density means to cause the density of the bottom portion of the toe weight means from the mid-height of the toe weight means downward to be greater than the density of the top portion of the toe weight means from the mid-height of the toe weight means upward. As stated in TABLE I, the data refer to a toe weight means including far toe weight 54 and central toe weight 60a comprised of a tungsten alloy at a density of 17.0 grams per cubic centimeter. When the density of the tungsten alloy of the entire central weight 60 is increased to 19.0 grams per cubic centimeter, the mass of head 32 increases by approximately a percentage point. This increase in density is also accompanied by the lowering of the center of mass 100 of head 32 toward ground surface 200 by about a half a percentage point.

The center of mass 100 may be lowered toward ground surface 200 in a more significant way by working with the larger masses in toe weight 54 and heel weight 56. For example, the volume of toe weight 54 from its mid-height downward may be comprised of a tungsten alloy of density 19.0 grams per cubic centimeter, and that from its mid-height upward may be comprised of a tungsten alloy of density at 13.0 grams per cubic centimeter.

Still another object was to have a mass distribution means to decrease the relative mass of the body and the toe weight means in the region of the toe section near the center of mass 100 of the clubhead 32 and to position a substantial portion of the mass of the toe weight means adjacent the toe 46 with the center of mass 102 of the toe weight means behind the extreme front of ball striking surface 40. It may be seen in FIGS. 2 and 5 that the relative mass consisting of body 36 and the toe weight means comprising central toe weight 60a and far toe weight 54 is identically zero in the immediate region of the center of mass 100 of head 32. Also from the data in TABLE I, and as previously discussed, some 90 percent of the toe weight means as far toe 54 is positioned adjacent the toe 46. Review of FIGS. 3 and 5 shows that center of mass 102 of the toe weight means is behind the extreme front of the ball striking surface 40 completing the objective.

Regarding the objective on mass and density separations, it is seen from TABLE I, that the ratio of masses between the toe weight means 54 and 60a and the complete mass of the toe section 66 is 0.814. In relation to density separation, the ratio of densities between the inertial material of the toe weight means 54 and 60a and the material in body 36 is 6.30. In some cases it will be desirable to have even greater ratios. In other cases as for a head 32 with a steel-lead combination where greater strength in body 36 is advantageous, either or both ratios may be less. Accordingly the ratio of masses may be at least 0.15. Furthermore, the ratio of densities may be at least 1.20.

In relation to higher density materials quite a wide variety of materials involving elements such as copper, lead, tungsten, rhenium, and gold would do. As suggested these may include the essentially pure element in forms such as powder, rod, or sheet; sinters of these elements other materials such as lead and copper; and the various alloys and compounds. More favorably, it is desirable that the inertial material of the toe weight means here comprising toe weights 54 and 60a have a density of at least 13.0 grams per cubic centimeter. Regarding the tungsten-containing material in particular, it is desirable that it have a tungsten content of at least 10 percent by weight.

Still another object was to have a toe weight means which has both a width and a height greater than its length. FIGS. 1–6 in the parent well illustrate such a clubhead. When in the present clubhead 32, central weight 60 is deleted the objective is also fulfilled.

SCOPE AND CONCLUSIONS

Thus, the head 32 may serve as a general model for clubheads stabilized with respect to moment of inertia about a reference such as vertical twist axis 206. Additionally, various means have been presented to upgrade head 32 so that it may have a center of mass 100 that is more favorably positioned. Since the invention is concerned primarily with mass and density distributions as well as certain length ratios, a suitable clubhead may be made for any person of any size and age.

While my above description contains many specificities, these should not be construed as limitations of the scope of the invention, but rather as another exemplification of a preferred embodiment thereof. Many other variations are possible.

Also, it will be readily seen by persons familiar with the art and science of designing golf clubs that the principles, practices, variations, modifications, and equivalents of the preferred embodiment of this invention may be readily applied to all classes of clubs including as well other monofacial putters, bifacial putters, woods, irons, and utility clubs as included within the spirit and scope of the appended claims.

While parameters such as hosel position, loft, total weight, shaft length, and grooves in the clubface may change from clubhead to clubhead, the appended claims do not relate to these parameters. Instead they relate primarily to the distribution and profiling of mass and density and to certain design ratios, primarily in the toe section of the clubhead. These distributions and profiles as well as the design ratios are common to all clubheads of the present invention.

Accordingly, the position of hosel 38 is not critical to this invention. Head 32 may be center-shafted as illustrated in FIGS. 1–3 and 5; or it may be heel-shafted; or less likely, in the case of putters, it may even be toe-shafted. If a part or all of hosel 38 resides in the toe section 66, then its proportional contribution to the mass should be included in that section. In fact hosel 38 is entirely optional as other known means such as a simple hole in head 32 would serve as a fastening means to affix a shaft 34 in some circumstances.

It may be instructive to take this a step further and consider how the design of golf club putter 30 might be approximately modified so as to make an iron or wood. As seen especially in FIG. 2, ball striking surface 40 is trapezoidal in shape with the length across top 50 being slightly less than that across sole 52. For an iron or wood, these lengths might be reversed so that the length across top 50 would be greater than across sole 52. This would amount to reversing the identation of head 32.

For both the iron and wood, hosel 38 would be strengthened and moved closer to the extreme of heel 48. In the case of the iron, hosel 38 would most likely be positioned at the front in the region of ball striking surface 40. For the wood, hosel 38 might be positioned in the region between ball striking surface 40 and back 44. Other changes would be similar in kind for both the iron and wood as follows.

Since head weights 54 and 56 are bound to head 32 by pins 58 and adhesive, it may be desirable to strengthen head 32 by placing head weights 54 and 56 in cavities behind ball striking surface 40 in a manner similar to that for head weight 60. As suggested, head 32 might be further strengthened by constructing body 36 with steel or beryllium-copper.

It is well known in the trade that the total mass of golf clubs is relatively constant throughout a set including putter, irons, and woods. Accordingly, as the length and mass of a shaft increases in progressing from putter, irons, and woods, the mass of a clubhead decreases proportionally.

Thus, the iron or wood head would be made with less mass by an amount approximately in proportion to the increase in mass of the shaft for the iron or wood over that for the golf club putter 30. Since the clubhead may now be heel-shafted, some mass might be rearranged between the far toe weight 54 and the far heel weight 56 so that there was something approximating a 60–40 split between the masses of the toe section 66 and heel section 68, respectively. Of course, central weight 60 and far heel weight 56 might be eliminated altogether and the invention would still retain its essential spirit as set forth in the appended claims.

Also, the loft of clubhead 32 could be increased and appropriate grooves added to ball striking surface 40. Too, the shape and size of the toe weight means might change somewhat in progressing from putter to iron and wood. However, the positioning of a substantial portion of its mass toward the toe 46 would remain constant, as would certain other parameters as defined in the appended claims. Regarding changes in size, the toe weight means might be substantially smaller and less massive for clubheads 32 of the iron or wood type because of the greater need for structural strength, and thereby mass, in the body 36 and hosel 38. Also, for clubheads of the iron-type the width **310*b* of toe weight 54** and of the toe weight means might be substantially reduced because an extended rearward projection might be unwanted.

Regarding changes in shape of the toe weight means, one possibility was presented in the parent where it was suggested that toe weight 54 might be made radial and extended along the partial circumference 207. Such an extension might apply particularly to a hollow wood wherein the weight 54 was bound to the peripheral walls of the interior cavity. In this example toe weight 54 might be applied internally by vapor deposition or plasma spray with the bonding being metallic or adhesive.

Figure 10:
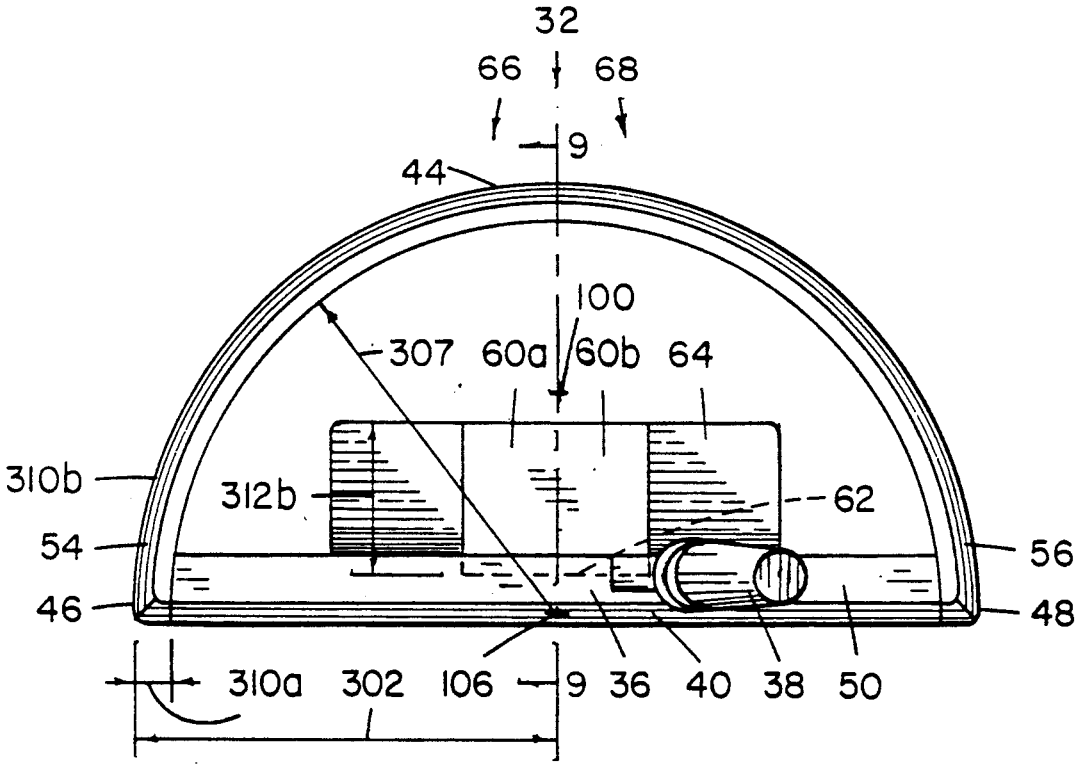
FIG. 10 is a top plan view of the clubhead of FIGS. 7–9.

As suggested in the parent, width **310*b* of weight 54 would then be interpreted as the maximum partial horizontal circumference of toe weight 54 and length 310*a* of toe weight 54 as the thickness of the partial cylinder. These ideas are illustrated in FIGS. 7–10 which show a clubhead similar to that in FIGS. 1–6. Here, the substantial portion of the mass of the toe weight means as toe weight 54 adjacent the toe 46 is extended behind ball striking surface 40 toward the vertical cut-plane 9—9 adjacent the back 44. This is seen in FIG. 10 particularly, where the length 310*a* of toe weight 54 is also its thickness, and where the width 310*b* runs along the maximum partial horizontal circumference of toe weight 54 from the intersection of ball striking surface 40 at the front and the toe 46 to the intersection of cut-plane 9—9 and the back 44**.

Thus, there is a possibility for a dual interpretation of the extended width of the toe weight means. One is width **310*b* of toe weight 54, and thereby the toe weight means, as discussed in the previous section. The other possible width is the distance along partial circumference 207 of the toe weight means. This potential for dual interpretation will not present a problem since the major thrust of the invention involves optimizing inertia by equating a conceptual pinpoint of mass at the toe 46 to a practical expanded surface of toe weight 54 adjacent the toe 46 and possibly elsewhere as suggested in the preceeding paragraph. The minor thrust of current invention revolves about control of the center of mass 100 of head 32** with volume and density profiles of the toe weight means. Within this context, and where reasonable cases for multiple interpreations exist, then the maximum width of the toe weight means may be identified and used for purposes of the appended claims.

Turning to the absolute data on masses and dimensions for head 32 as set forth in TABLE I; these are not particularly critical to the invention. For a small child's clubhead some or all of these may be less, while for a large adult's clubhead some or all of these may be more. In any case, a clubhead according to the current invention need not be unusally heavy, long, wide, or high.

As suggested, body casting with a metal is considered to be a preferred method of constructing a strong unitary version of the body 36 of this invention. However, for other cases any manufacturing process and any materials of appropriate density capable of providing the desired combination of strength, durability, mass distribution, volume and density profiles, and other design ratios will be satisfactory.

Vertical twist axis 206 through geometric center 106 as depicted in FIG. 4 is felt to be an excellent practical reference for moment of inertia and resistance to twisting for toe section 66, specifically, and head 32, generally. However, other vertical axis reference means such as a vertical axis through center of mass 100 of head 32 would also do in most circumstances.

Accordingly, the scope of the invention should not be determined by the embodiment illustrated, but by the appended claims and their legal equivalents.

What is claimed is:

1. A golf clubhead comprising:

a. a body having a predetermined lower density;

b. a head weight means comprising at least one head weight whereby each said head weight has a predetermined higher density greater than said predetermined lower density of said body as inertial weight for said clubhead;

c. a toe and heel, a front and back, and a top and a sole with a ball striking surface toward said front;

d. a binding means to attach said head weight means to said clubhead;

e. a fastening means to affix a shaft between said heel and said toe;

f. a toe section extending from a vertical plane positioned perpendicularly at the midpoint of the length line of said clubhead to the extreme of said toe, and a heel section extending from said vertical plane in the opposite direction to the extreme of said heel;

g. a toe weight means comprising at least one toe weight of the portion of said head weight means in said toe section as inertial weight for said toe section;

h. a mass profile means to position:

(i) a substantial portion of the mass of said toe weight means away from the center of mass of said clubhead toward said toe; and (ii) the center of mass of said toe weight means behind the extreme front of said ball striking surface no higher than the mid-height of said toe weight means;

i. a characteristic feature of said substantial portion of the mass of said toe weight means adjacent said toe comprising an expanded surface whereby both the height and width of said substantial portion of said toe weight means are generally greater than the length of said substantial portion of said toe weight means;

j. whereby, said clubhead is inertially stabilized with respect to twisting.

2. The golf clubhead of claim 1 whereby said mass profile means includes a volume means to cause the volume of the bottom portion of said toe weight means from the mid-height of said toe weight means downward to be at least as great as the volume of the top portion of said toe weight means from the mid-height of said toe weight means upward.

3. The golf clubhead of claim 1 whereby said mass profile means includes a density means to cause the density of the bottom portion of said toe weight means from the mid-height of said toe weight means downward to be greater than the density of the top portion of said toe weight means from the mid-height of said toe weight means upward.

4. The golf clubhead of claim 2 whereby said substantial portion of the mass of said toe weight means adjacent said toe is extended behind said ball striking surface toward said vertical plane adjacent said back.

5. The golf clubhead of claim 2 whereby the ratio of masses between said toe weight means and the complete mass of said toe section is at least 0.15; and whereby the the ratio of densities between said toe weight means and said body of said clubhead in said toe section is at least 1.20.

6. The golf clubhead of claim 5 whereby the density of said toe weight means is at least 13.0 grams per cubic centimeter.

7. The golf clubhead of claim 6 whereby said toe weight means has a content of tungsten of at least 10 percent by weight.

8. The golf clubhead of claim 7 which is a body casting with at least one cavity to bind at least one said toe weight to said toe section.

9. The golf clubhead of claim 8 whereby both the width and the height of said toe weight means are greater than the length of said toe weight means.

10. The golf clubhead of claim 3 whereby said substantial portion of the mass of said toe weight means adjacent said toe is extended behind said ball striking surface toward said vertical plane adjacent said back.

11. The golf clubhead of claim 3 whereby the ratio of masses between said toe weight means and the complete mass of said toe section is at least 0.15; and whereby the the ratio of densities between said toe weight means and said body of said clubhead in said toe toe section is at least 1.20.

12. The golf clubhead of claim 11 whereby the density of said toe weight means is at least 13.0 grams per cubic centimeter with a content of tungsten of at least 10 percent by weight.

13. The golf clubhead of claim 12 which is a body casting with at least one cavity to bind at least one said toe weight to said toe section.

14. The golf clubhead of claim 13 whereby both the width and the height of said toe weight means are greater than the length of said toe weight means.

15. A golf clubhead comprising:

a. a body having a predetermined lower density;

b. a head weight means comprising at least one head weight whereby each said head weight has a predetermined higher density greater than said predetermined lower density of said body as inertial weight for said clubhead;

c. a toe and heel, a front and back, and a top and a sole with a ball striking surface toward said front;

d. a binding means to attach said head weight means to said clubhead;

e. a fastening means to affix a shaft between said heel and said toe;

f. a toe section extending from a vertical plane positioned perpendicularly at the midpoint of the length line of said clubhead to the extreme of said toe, and a heel section extending from said vertical plane in the opposite direction to the extreme of said heel; and g. said toe section including:

(i) a toe weight means comprising at least one toe weight of the portion of said head weight means in said toe section as inertial weight for said toe section;

(ii) a mass distribution means to decrease the relative mass of said body and said toe weight means in the region of said toe section near the center of mass of said clubhead and to position a substantial portion of the mass of said toe weight means adjacent said toe with the center of mass of said toe weight means behind the extreme front of said ball striking surface; and (iii) a characteristic feature of said substantial portion of said toe weight means adjacent said toe comprising an expanded surface whereby both the width and the height of said substantial portion of said toe weight means are generally greater than the length of said substantial portion of said toe weight means so that said clubhead is inertially stabilized when a golf ball is struck.

16. The golf clubhead of claim 15 whereby said substantial portion of the mass of said toe weight means adjacent said toe is extended behind said ball striking surface toward said vertical plane adjacent said back.

17. The golf clubhead of claim 15 whereby the ratio of masses between said toe weight means and the complete mass of said toe section is at least 0.15; and whereby the ratio of densities between said toe weight means and said body of said clubhead in said toe section is at least 1.20.

18. The golf clubhead of claim 19 whereby the density of said toe weight means is at least 13.0 grams per cubic centimeter with a content of tungsten of at least 10 percent by weight.

19. The golf clubhead of claim 18 which is a body casting.

20. The golf clubhead of claim 19 whereby both the width and the height of said toe weight means are greater than the length of said toe weight means.

* * * * *

UNITED STATES PATENT AND TRADEMARK OFFICE

CERTIFICATE OF CORRECTION

PATENT NO. : 4,999,000

DATED : Mar. 12, 1991

INVENTOR(S) : Clifton D. Finney

It is certified that error appears in the above-identified patent and that said Letters Patent is hereby corrected as shown below:

Col 18, line 54, change "of claim 19" to --of claim 17--.

Signed and Sealed this

First Day of September, 1992

*Attest:*

*Attesting Officer*

DOUGLAS B. COMER

*Acting Commissioner of Patents and Trademarks*